US008385585B2

(12) United States Patent
Kang et al.

(10) Patent No.: US 8,385,585 B2
(45) Date of Patent: Feb. 26, 2013

(54) SPEAKER

(75) Inventors: Seung-won Kang, Suwon-si (KR); Hag-do Kim, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 225 days.

(21) Appl. No.: 12/877,409

(22) Filed: Sep. 8, 2010

(65) Prior Publication Data

US 2011/0064261 A1 Mar. 17, 2011

Related U.S. Application Data

(60) Provisional application No. 61/243,275, filed on Sep. 17, 2009, provisional application No. 61/260,936, filed on Nov. 13, 2009.

(30) Foreign Application Priority Data

Dec. 24, 2009 (KR) ..... 10-2009-0131020

(51) Int. Cl.
*H04R 1/00* (2006.01)
*H04R 9/06* (2006.01)
*H04R 11/02* (2006.01)

(52) U.S. Cl. ..... 381/426; 381/432

(58) Field of Classification Search ..... 381/396, 381/400–405, 412, 423, 426, 432; 181/148, 181/152, 157, 159, 167–170
See application file for complete search history.

(56) References Cited

U.S. PATENT DOCUMENTS 5,206,466 A * 4/1993 Inamiya ..... 181/169
2007/0076906 A1 * 4/2007 Takagi et al. ..... 381/118

* cited by examiner

*Primary Examiner* — Tuan D Nguyen
(74) *Attorney, Agent, or Firm* — Stanzione & Kim, LLP

(57) ABSTRACT

A speaker includes a speaker body; a cone paper movably supported by the speaker body; and a magnetic driving unit disposed on the speaker body to vibrate the cone paper, wherein the cone paper includes at least two layers made of different materials.

18 Claims, 13 Drawing Sheets

SPEAKER

CROSS-REFERENCE TO RELATED APPLICATIONS

This application claims priority from U.S. Provisional Patent Application Nos. 61/243,275, filed on Sep. 17, 2009, and 61/260,936, filed on Nov. 13, 2009, in the United States Patent and Trademark Office, and from Korean Patent Application No. 10-2009-131020, filed on Dec. 24, 2009, in the Korean Intellectual Property Office, the disclosures of which are incorporated herein in their entirety by reference.

BACKGROUND OF THE INVENTION

1. Field of the Invention

The present general inventive concept relates to a speaker to convert an electrical signal into sound.

2. Description of the Related Art

Usual speakers convert an electrical signal into an acoustic signal by Fleming's right hand rule which shows the direction of induced current flow when a conductor moves in a magnetic field. The general operation of a speaker is disclosed in Korean Patent Application No. 10-2005-0020540 filed on Mar. 11, 2005 by the same inventor.

Such a speaker uses a cone paper as a conversion element to convert mechanical energy into acoustical energy. The cone paper receives vibration of a voice coil, and thus causes air pressure to be changed. By doing so, the cone paper affects approximately 90% or more of the sound quality, and different sounds may be produced according to material properties, fabrication parameters, structural geometry (shape), and so on.

Generally, to fabricate a cone paper, pulp is most widely used since it is cheap, enables sound to be adjusted easily, and it is easy to make shape. And polypropylene which makes the appearance more beautiful and more tolerant to shock may also be used.

The cone paper made of pulp may be formed with various materials, and thus the pulp is advantageous in terms of producing various sounds. However, if the cone paper is externally exposed, its appearance is not good and is fragile against shock impact.

The cone paper made of polypropylene may be formed in various shapes, and thus the polypropylene is advantageous in terms of providing better appearance and is more shock-resistant. However, polypropylene is restrictively used for a specific speaker since the speaker made of polypropylene produces relatively dead sound compared to the cone paper made of pulp due to the problem caused by the material or the method for forming appearance.

SUMMARY OF THE INVENTION

The present general inventive concept provides a speaker having an improved structure which can produce distinctive sound, and can be formed in a characteristic shape.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a speaker, including a speaker body, a cone paper movably supported by the speaker body, and a magnetic driving unit disposed on the speaker body to vibrate the cone paper, wherein the cone paper may include at least two layers made of different materials.

The cone paper may include a first layer externally exposed, and made of polypropylene; and a second layer attached to a bottom surface of the first layer by either glue or a physical way, and made of pulp.

The ratio of the thickness of the first and second layers may be 1:1.

The cone paper may include a neck adhesive portion which is apart from a center of the cone paper at a predetermine distance, occupy approximately 25% to 35% of the entire surface area of the cone paper, and may be coupled with a dust cap, wherein the second layer may be removed from the neck adhesive portion. The thickness of the first layer of the neck adhesive portion may be adjusted to be 101% to 200% of the first layer.

The thickness of the second layer of the neck adhesive portion may be adjusted to be 101% to 200% of the second layer.

The foregoing and/or other aspects and utilities of the present general inventive concept may also be achieved by providing a speaker including a speaker body, a diaphragm movably disposed to vibrate with respect to the speaker body. The diaphragm may be made of at least two different materials.

The diaphragm may include at least two layers formed of the corresponding at least two different materials.

The diaphragm may have at least a portion having the at least two different materials which overlap each other in a vibration direction of the diaphragm.

The diaphragm may include a first layer formed by a first material and a second layer formed by a second material. The first layer and the second layer may be disposed on each other in a vibration direction of the diaphragm.

The speaker may further include a driving unit having an element movably disposed on the speaker body to vibrate the diaphragm with respect to the speaker body. The diaphragm may further include at least two layers formed of the corresponding at least two different materials. One of the first layer and the second layer may have opposite ends connected to the speaker body and the element of the driving units.

The other one of the first layer and the second layer may have another opposite ends connected to the speaker body and the element of the driving units through the corresponding opposite ends of the one of the first layer and the second layer.

The speaker may further include a driving unit having an element movably disposed on the speaker body to vibrate the diaphragm with respect to the speaker body, and the diaphragm may include at least two layers formed of the corresponding at least two different materials. The first layer may have one end coupled to the element of the driving unit, and the second layer may have one end fixedly coupled to the speaker body.

The first layer and the second layer may have center portions to overlaps each other in the vibrating direction.

The element of the driving unit may include a bobbin and a coil, and the one end of the element is the bobbin.

The driving unit may further include another element disposed to control the element to vibrate the diaphragm in the vibration direction.

The speaker may further include a driving unit having an element movably disposed on the speaker body to vibrate the diaphragm, and the diaphragm may include a first end portion connected to the element of the driving unit, a second end portion fixedly connected to the speaker body, and a middle portion formed between the first portion and the second portion to vibrate according to the movement of the element of the driving unit with respect to the speaker body.

The first end portion and the second end portion may be made of the different materials, and the at least one of the different materials of the first end portion and the second end portion is connected to the element and the speaker body.

The first end portion and the second end portion may be made of the different materials.

Each of the first end portion, the second portion, and the middle portion may be made of the at least two different materials.

At least one of the first end portion and the second end portion may be made of at least one of the at least one of the different materials, and the middle end portion may be made of the at least two different materials.

The driving unit may receive an electrical signal from an external unit, and the driving unit may convert the electrical signal into vibration through the element to vibrate the diaphragm.

The diaphragm may include a first layer and a second layer which are made of corresponding ones of the at least two different materials, and the first layer may have a first length and the second layer may have a second length.

The first length may be different from the second length in a surface direction of the diaphragm. The first length and the second length may be same.

The diaphragm may include a first layer and a second layer which are made of corresponding ones of the at least two different materials, and the first layer may have a first thickness and the second layer may have a second thickness.

At least one of the first thickness and the second thickness may be variable with respect to a surface direction of the diaphragm.

The diaphragm may have a thickness variable with respect to a surface direction of the diaphragm.

The diaphragm may have a ratio of the at least two different materials with respect to a surface direction of the diaphragm, and the ratio of the at least two different materials may vary according to a distance from the speaker body.

The at least two different materials of the diaphragm may be polypropylene and pulp.

The foregoing and/or other aspects and utilities of the present general inventive concept may be achieved by providing a speaker including a speaker body, a cone paper movably supported by the speaker body and disposed to vibrate with respect to the speaker body as a diaphragm, and a magnetic driving unit disposed on the speaker body to vibrate the cone paper, and the cone paper may include at least two layers made of different materials.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
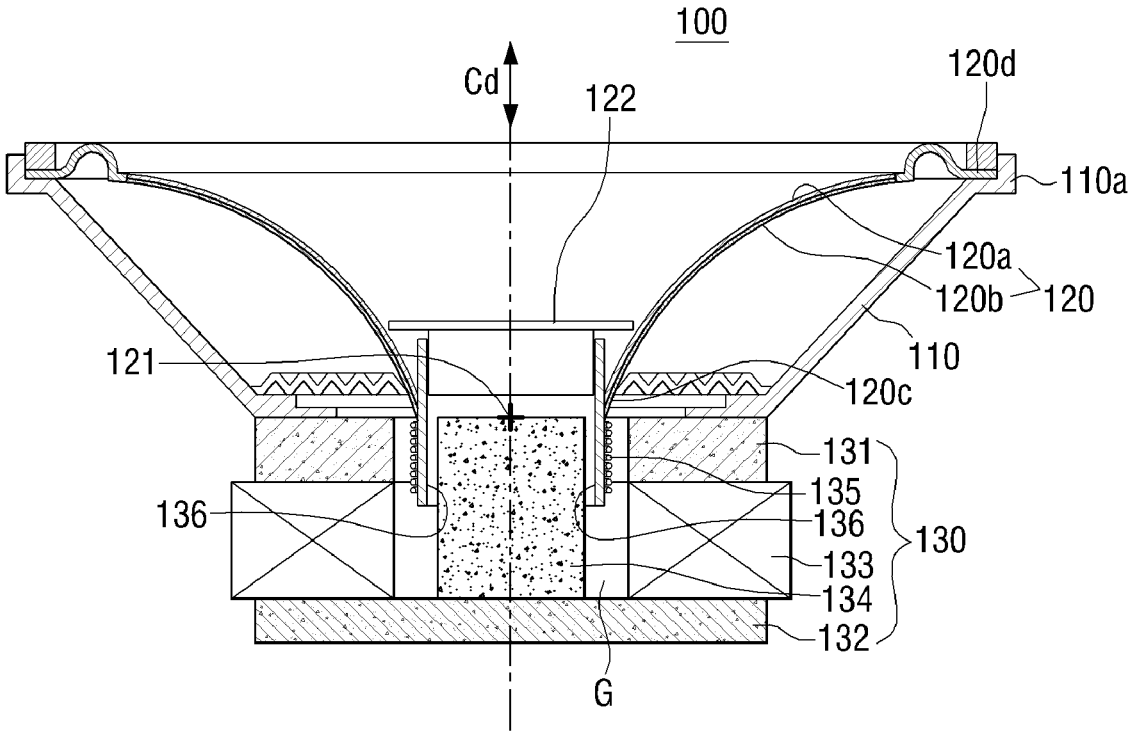
FIG. 1 is a sectional view illustrating a speaker according to an exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

A speaker according to an exemplary embodiment of the present general inventive concept will be explained in detail with reference to the accompanying drawings.

Referring to FIG. 1, a speaker 100 according to an exemplary embodiment of the present general inventive concept includes a speaker body 110, a cone paper 120, and a magnetic driving unit 130. The cone paper 120 may be referred to as a diaphragm to vibrate with respect to a reference. Although the cone paper 120 is illustrated as the diaphragm, the present general inventive concept is not limited thereto. The diaphragm may be a flat paper or made of different materials.

The speaker body 110 supports the cone paper 120 and the magnetic driving unit 130, and forms appearance of the speaker 100.

The cone paper 120 is movably supported by the speaker body 110. The cone paper 120 may be configured in a cone shape such that a center 121 of a circle corresponding to the cone paper 120 vibrates in a center direction Cd of FIG. 1, and thus to produce sound. A dust cap 122 is covered on the center 121 to prevent contaminants from entering the center 121. The cone paper 120 will be explained later in detail.

The magnetic driving unit 130 is mounted to the speaker body 110, and vibrates the cone paper 120 according to an electrical signal transmitted from an external device (not illustrated). The magnetic driving unit 130 includes a permanent magnet 133 between upper and lower metal plates 131 and 132. An inner magnet 134 is provided on a portion opposite an inner diameter of the permanent magnet 133 and protrudes upward to have a predetermined gap from the upper metal plate 131.

A bobbin 136 around which a voice coil 135 is wound is inserted into a gap G between the permanent magnet 133 and the inner magnet 134, and an upper end of the bobbin 136 is connected to a lower end 120*c* of the cone paper 120. An upper end 120*d* of the cone paper 120, such as a surround, is fixed on an upper portion 110*a* of the speaker body 110 which is fixed on the metal plate 131. By doing so, the magnetic driving unit 130 controls the cone paper 120 to vibrate with respect to the speaker body 110 according to an electrical signal applied to the voice coil 135 of the bobbin 136 and a magnetic field formed by the inner magnet 134 and the permanent magnet 133, thereby producing sound according to the vibration of the cone paper 120.

The structure and operation of the magnetic driving unit 130 are the same as those of conventional speakers, and detailed description will be omitted.

According to the exemplary embodiment of the present general inventive concept, the cone paper 120 is configured to have a plurality of layers made of different materials. In this exemplary embodiment of the present general inventive concept, two layers of the different materials are attached to each other using glue or any other physical way. A first layer 120*a* externally exposed may be made of polypropylene, and a second layer 120*b* may be coupled on a bottom surface of the first layer 120*a*. A ratio of thicknesses of the first and second layers 120*a* and 120*b* is 1:1. The first layer 120*a* may be externally exposed to an outside of the speaker 100 and is made of polypropylene which provides more beautiful appearance and greater durability than pulp. The second layer 120*b* may be disposed to face the speaker body 110 or the magnet driving unit 130 in a direction opposite to the outside of the speaker 100 with respect to the cone paper 120.

As described above, the cone paper 120 is made of two layers 120*a* and 120*b*. The cone paper 120 may be lighter than a cone paper made of a single material such as polypropylene, pulp, aluminum, wood, and so on, in weight by 10% or more. In addition, since the second layer 120*b* attached to a bottom surface of the first layer 120*a* is referred to as an internal layer made of pulp, sound loss is reduced in the speaker 100. Therefore, the speaker 100 maintains or improves flat sound producing characteristics while increasing a sound pressure level (SPL).

Figure 2:
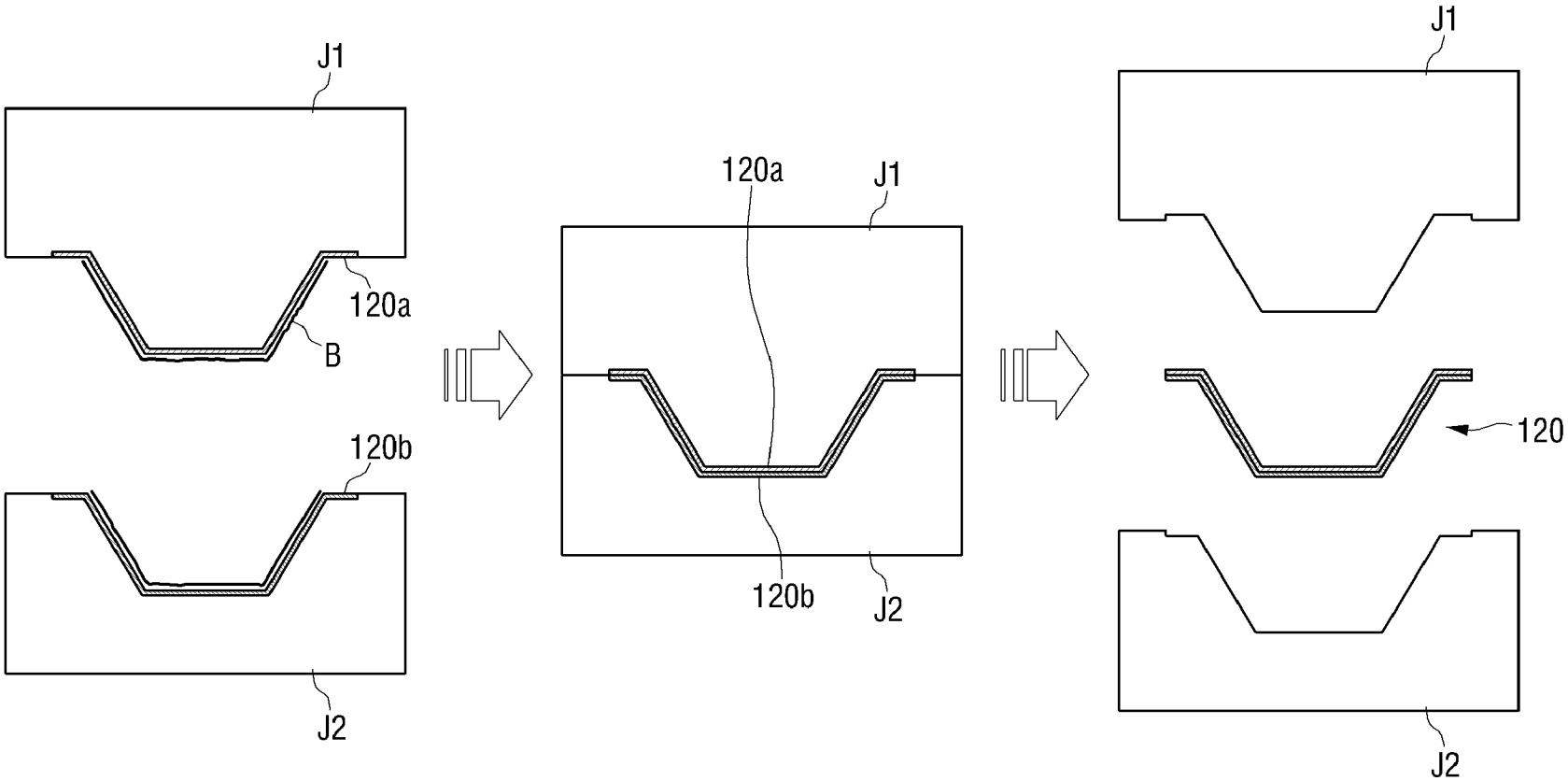
FIGS. 2 and 3 are views illustrating a method of fabricating a cone paper of a speaker according to an exemplary embodiment of the present general inventive concept.

FIG. 2 is a view illustrating a method of attaching two layers 120*a* and 120*b* of the cone paper 120 of the speaker 100 using a coupling unit B, for example, glue. As illustrated in FIG. 2, the first and second layers 120*a* and 120*b* which have been fabricated in a separate process to have the same thickness and surface area are positioned on first and second jigs J1 and J2. A glue B is spread on one or both surfaces of the first and second layers 120*a* and 120*b* facing with each other, and the first and second jigs J1 and J2 are pressed against each other to dispose the first and second layers 120*a* and 120*b* with respect to the glue B. In this situation, sound may be produced differently from the cone paper 120 by the change of a material, a thickness or a type of the glue B. And a characteristic of sound produced from the cone paper 120 may vary according to a characteristic of the glue B.

Figure 3:
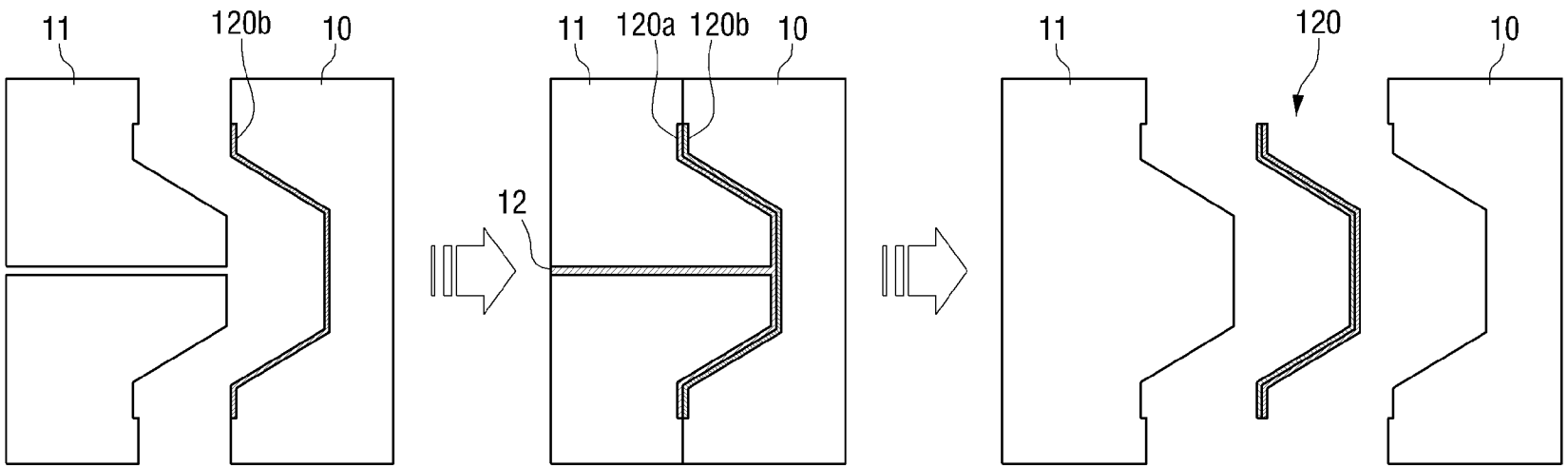

FIG. 3 is a view illustrating a method of physically attaching two layers 120*a* and 120*b* of the cone paper 120 of the speaker 100. The second layer 120*b* which is made of pulp in a separate process is positioned on a mold base 10. A mold cover 11 having the shape of the cone paper 120 is affixed to the mold base 10 to have a space corresponding to a shape of the first layer 120*a*, and then polypropylene is inserted or injected into an inlet 12 of the mold cover 11. The cone paper 120 is fabricated by injection molding. According to such a fabricating method, the cone paper 120 which includes two layers made of different materials may be configured by injection molding without spreading or applying glue on the first and/or second layers 120*a* and 120*b*.

The cone paper 120 having the structure of layer-by-layer according to the exemplary embodiments of the present general inventive concept may be fabricated by one of the above two methods, but the present general inventive concept is not limited thereto. The cone paper 120 may have different layers made of different materials, for example, the first layer 120*a* made of polypropylene, and the second layer 120*b* made of pulp or the first layer 120*a* made of a material having a characteristic similar to polypropylene, and the second layer 120*b* made of a material having a characteristic similar to pulp.

Figure 4:
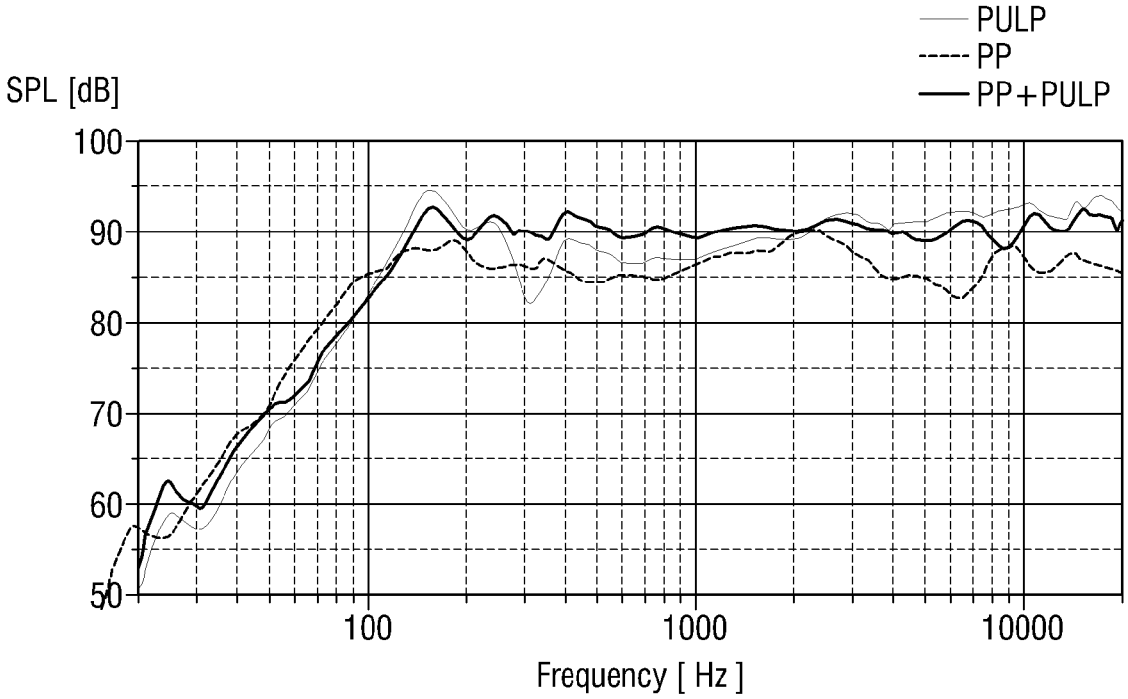
FIG. 4 is a graph illustrating comparing a sound pressure level (SPL) of a conventional cone paper made of a single material with an SPL of a cone paper according to an exemplary embodiment of the present general inventive concept.

FIG. 4 is a graph illustrating comparing an SPL of the cone paper 120 having the polypropylene layer and the pulp layer with an SPL of a conventional cone paper made of only polypropylene and an SPL of a conventional cone paper made of only pulp. As illustrated in the graph of FIG. 4, the SPL of the cone paper 120 having two layers according to the exemplary embodiment of the present general inventive concept is approximately 4 dB higher than that of a cone paper made of only polypropylene, and the cone paper 120 maintains flat sound producing characteristics better than that of a cone paper made of only pulp.

Figure 5:
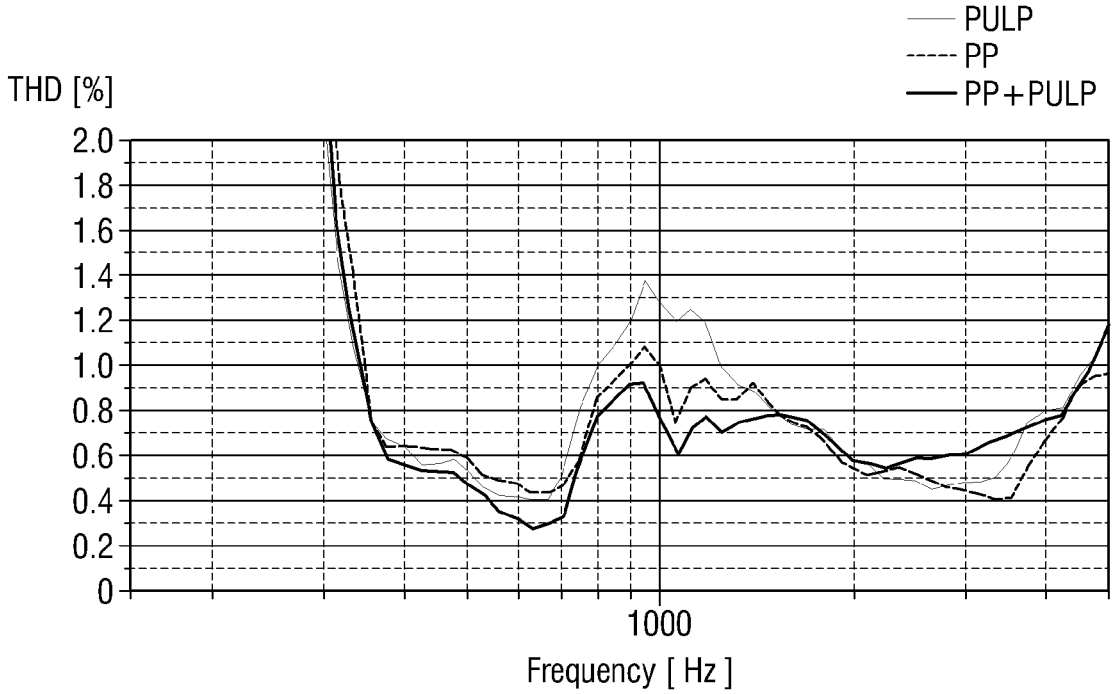
FIG. 5 is a graph illustrating comparing a total harmonic distortion (THD) of a conventional cone paper made of a single material with a THD of a cone paper according to an exemplary embodiment of the present general inventive concept.

FIG. 5 is a graph illustrating comparing a total harmonic distortion (THD) of a conventional cone paper made of a single material, such as polypropylene or pulp, with a THD of the cone paper 120 having two layers made of different materials according to an exemplary embodiment of the present general inventive concept. As illustrated in the graph of FIG. 5, using different materials minimizes separation vibration of the cone paper 120 having the two layers, thereby producing clear sound. Table 1 shows a Young's modulus, an acoustic velocity, and an internal loss of the cone paper 120 which are the main three factors of the cone paper 120. It can be seen that the cone paper 120 fabricated using two kinds of material, that is, polypropylene and pulp, has a wider range in the characteristics such as the Young's modulus, the acoustic velocity, and the internal loss than the cone paper formed of a single material.

TABLE 1

| Material Type | Young's Modulus [$\times 10^{10}$ N/m$^2$] | Acoustic Velocity [m/s] | Internal Loss [tan δ] |
|---|---|---|---|
| Pulp | 0.03~0.6 | 1200~3700 | 0.02~0.1 |
| Polypropylene | 2.0~4.0 | 1800~2200 | 0.07 |
| Polypropylene + Pulp | 0.03~4.0 | 1200~2200 | 0.02~0.09 |

The cone paper 120 includes a neck adhesive portion 125 which is a portion apart from the center 121 or an axis passing the center 121 in the direction Cd at a predetermined distance. The neck adhesive portion 125 is disposed to cover or occupy approximately 25% to 35% of the entire surface area of the cone paper 120, and the dust cap 122 is disposed to cover the neck adhesive portion 125. The neck adhesive portion 125 may be disposed to cover or occupy approximately 30% of the entire surface area of the cone paper 120, and the surface area occupying the cone paper 120 may be changed according to the size of the dust cap 122.

The cone paper 120 may be designed in different ways depending on different usage in such a manner of changing the thickness of the neck adhesive portion 125 while maintaining the ratio of the thickness of the first and second layers 120*a* and 120*b* of the cone paper 120 to be 1:1. The neck adhesive portion 125 is hidden from the outside of the speaker 100 by being connected to the dust cap 122 as illustrated in FIGS. 6, 7, and 8, thereby producing desired sound without damaging the appearance of the speaker 100.

Figure 6:
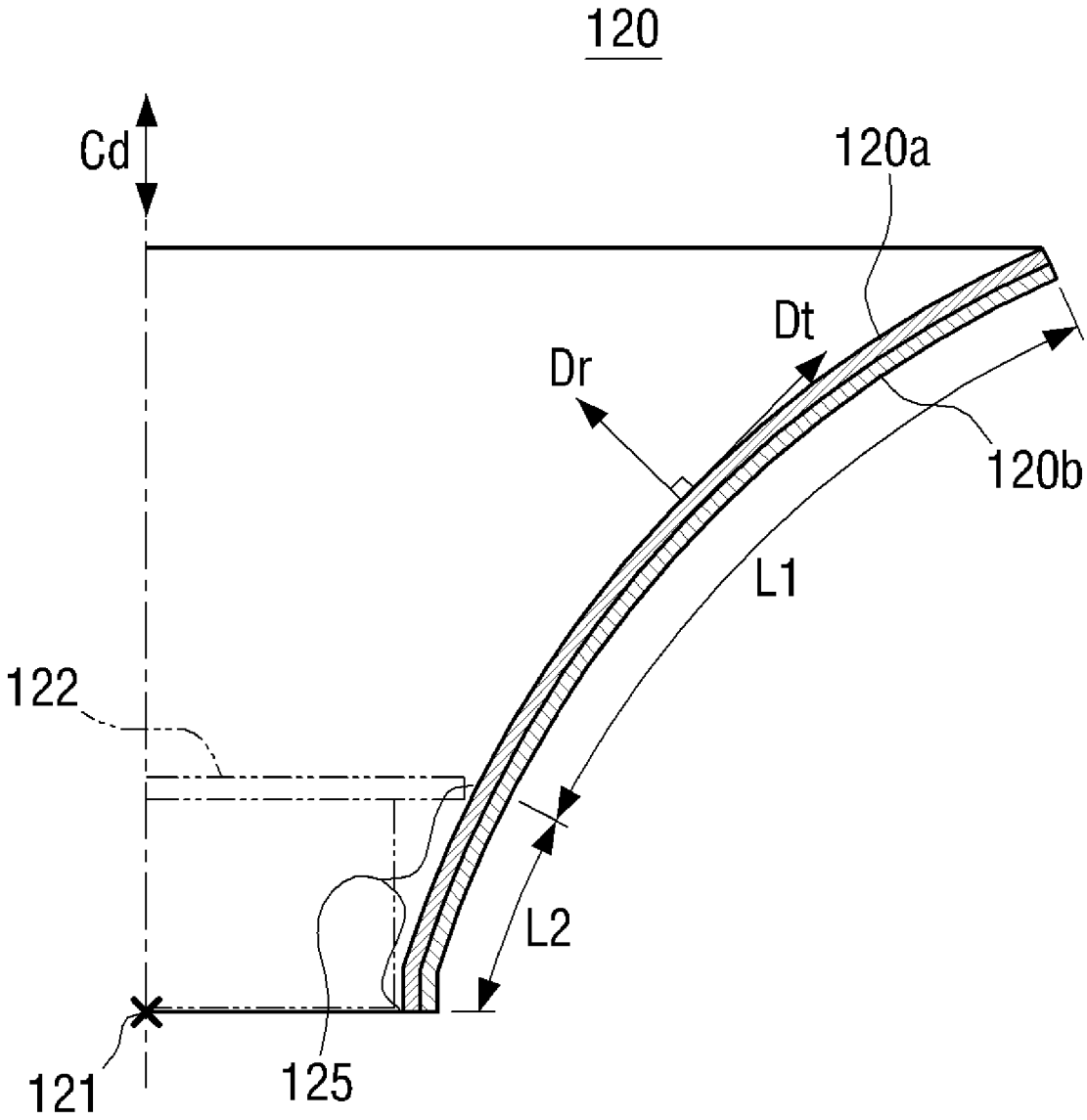
FIGS. 6, 7, and 8 are sectional views illustrating structures of cone papers according to various exemplary embodiments of the present general inventive concept.

For instance, in a first type of the cone paper 120 illustrated in FIG. 6, if a ratio of the thicknesses of the first and second layers 120*a* and 120*b* is 1:1, and the first and second layers 120*a* and 120*b* are formed to have the same surface area, the cone paper 120 maintains flat sound producing characteristics between a center frequency of a band unit and a frequency of 20 kHz. Therefore, the cone paper 120 may also be used as a full-band unit of an exposed speaker may be used. In addition, the first layer 120*a* made of polypropylene may enable the speaker 100 (referring to FIG. 1) to have more beautiful appearance and to produce distinctive sound from those of other speakers.

A portion of the cone paper 120 corresponding to the neck adhesive portion 125 may have a length L2 in a surface direction of the cone paper 120, and a remaining portion of the cone paper 120 may have a length L1 in a surface direction of the cone paper 120. A thickness of the first layer 120*a* may be same as a thickness of the second layer 120*b* in a direction Dr. The surface direction may have an angle with the direction Dr. The first layer 120*a* and the second layer 120*b* may be disposed on a plane or a flat surface parallel to a direction Dt. A ratio of the length L1 and L2 may vary depending on a type of the cone paper, for example, a different shape of a loudspeaker. The shape may be a cone shape or a flat shape. It is possible that the length L2 may be zero in a case of a flat diaphragm disposed on the flat surface or plane. Although a terminology of "cone" is used to describe the cone paper 120, the present general inventive concept is not limited thereto. The cone paper 120 may have a different shape from a cone shape.

Figure 7:
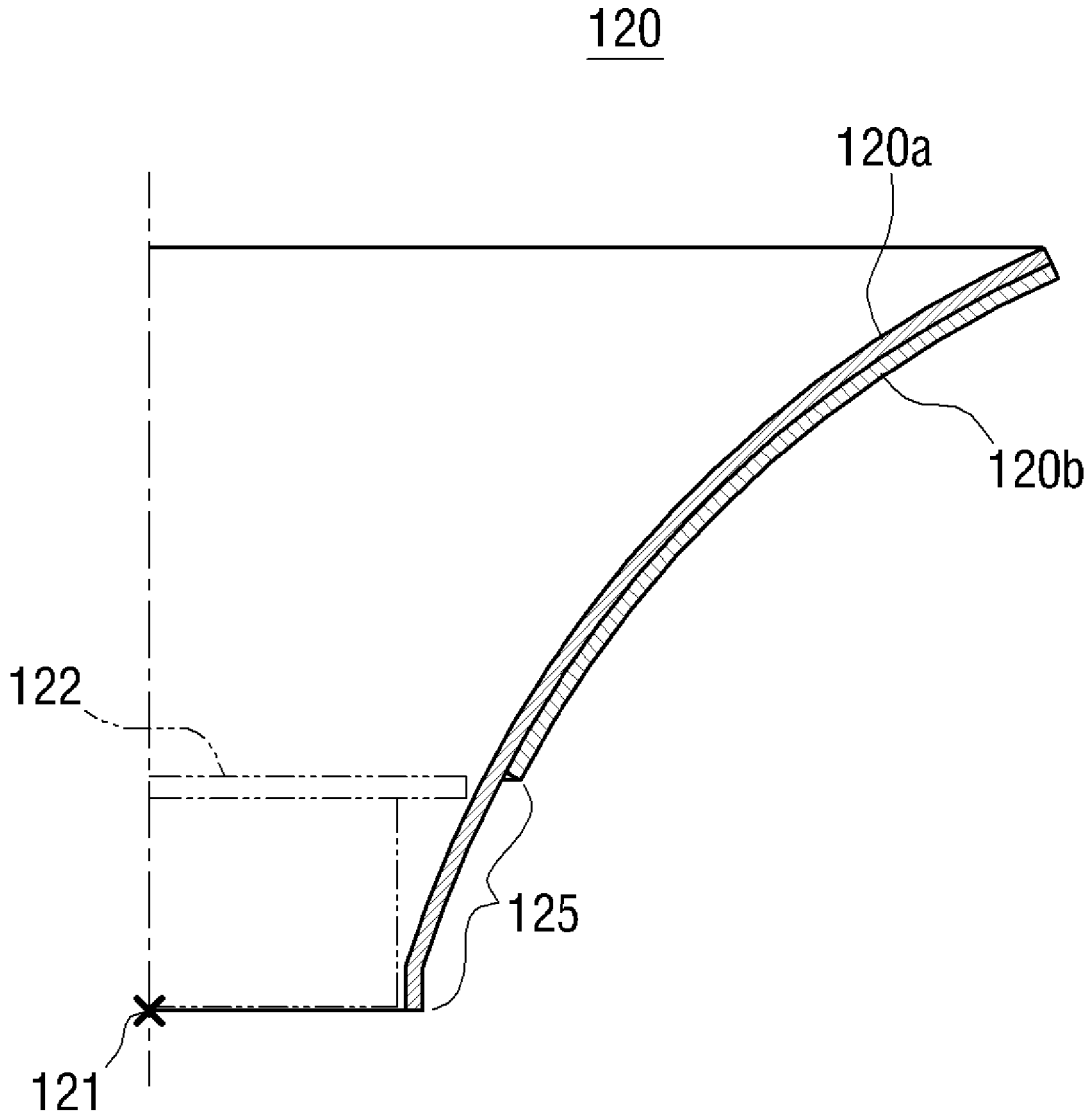
Figure 8:
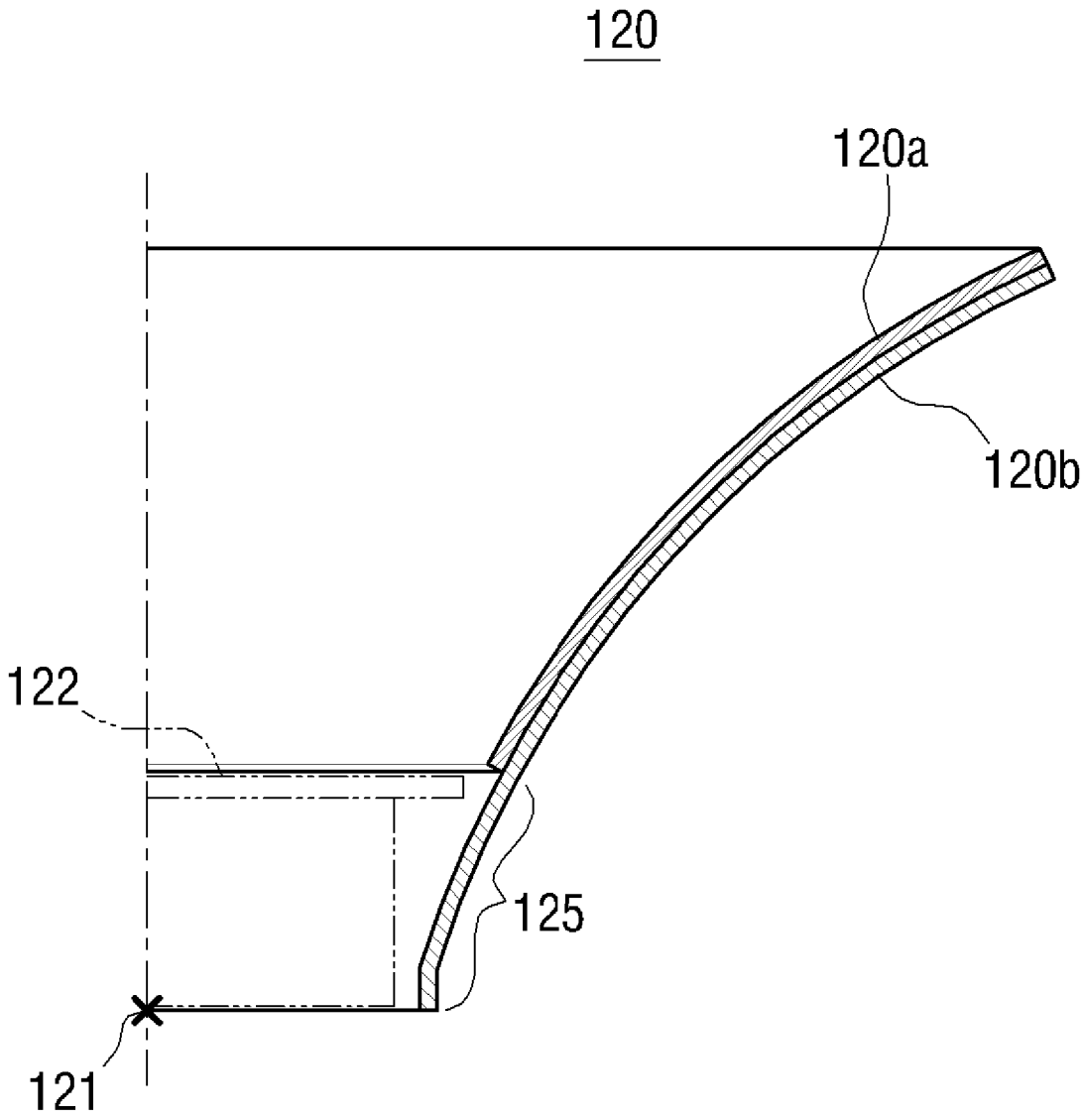

Alternatively, in a second type of the cone paper 120 illustrated in FIG. 7, if a portion of the second layer 120*b* corresponding to the neck adhesive portion 125 is removed, the cone paper 120 may be used as a cone paper of a unit for a lower tone (or a lower frequency band) of a two-way speaker. In this case, the peak and the extensibility in a higher tone (or a mid-high frequency band) may be controlled by adjusting the thickness of the first layer 120*a* made of polypropylene in the neck adhesive portion 125, from which the second layer 120*b* is removed, to be in a range of 101% to 200% corresponding to the thickness of the cone paper 120.

Alternatively, in a third type of the cone paper 120 illustrated in FIG. 8, if a portion of the first layer 120*a* corresponding to the neck adhesive portion 125 is removed, the cone paper 120 may be used as a cone paper of a unit for a full-band. In this case, the regeneration ability of mid-high band may be controlled by adjusting the thickness of the second layer 120*b* made of pulp in the neck adhesive portion 125, from which the first layer 120*a* is removed, to be within a range of 101% to 200% which is within the thickness of the cone paper 120. Therefore, specialized sound tone of each region may be produced without changing the shape of the speaker.

Figure 9:
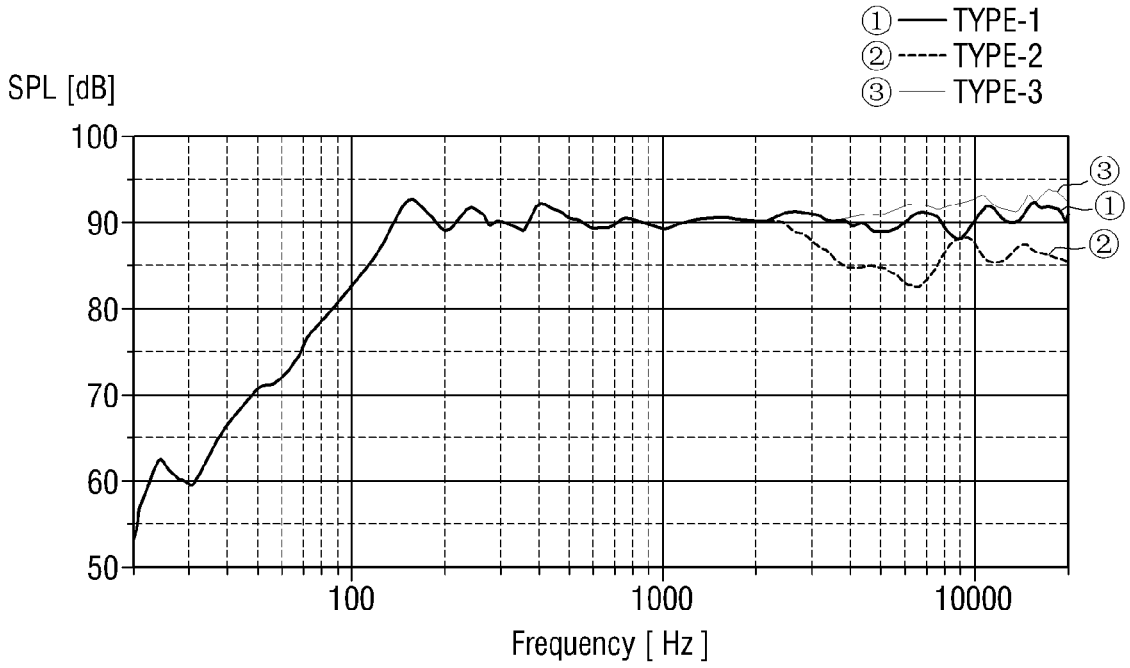
FIG. 9 is a graph illustrating SPLs of the cone papers of FIGS. 6, 7, and 8.

FIG. 9 is a graph illustrating SPLs of the first to third types of the cone paper 120 of FIGS. 6, 7, and 8.

As illustrated in FIG. 9, if the thickness of the second layer 120*b* which is made of pulp causing a high internal loss is thick, slight variation of peak appears in the mid-high band, and if the thickness of the first layer 120*a* which is made of polypropylene having sufficient elasticity is thick, notable variation of peak is caused in the mid-high band.

Figure 10:
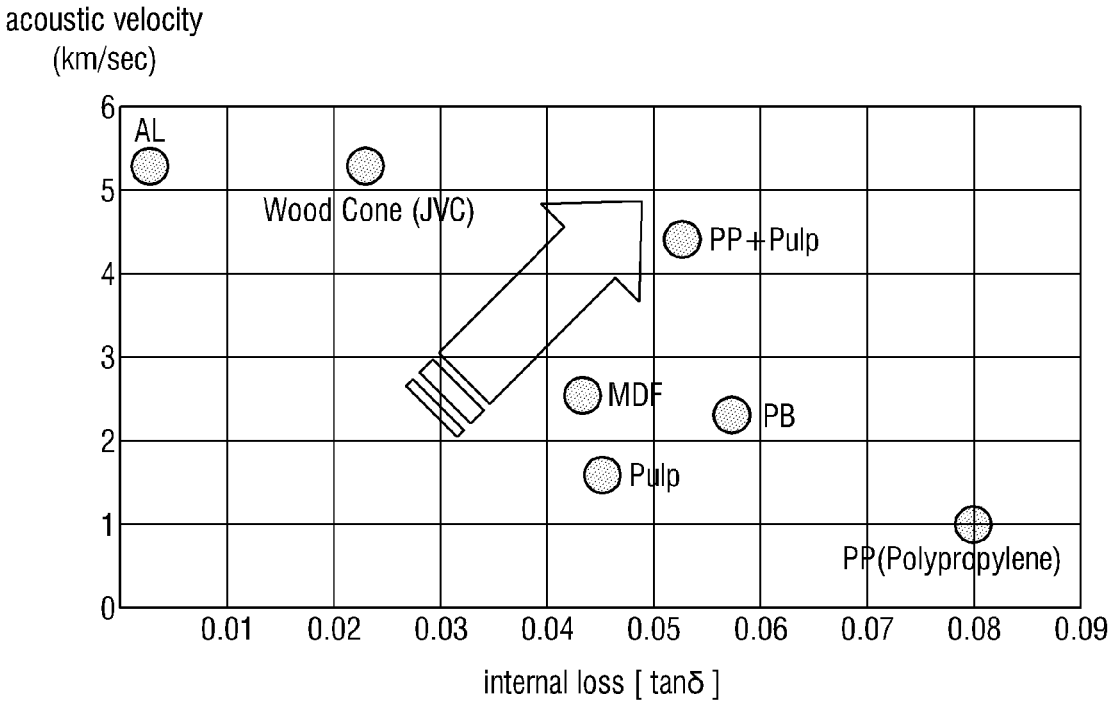
FIG. 10 is a graph illustrating comparing the characteristics of a conventional cone paper made of single material with those of a cone paper of a speaker according to an exemplary embodiment of the present general inventive concept.

FIG. 10 compares the cone paper 120 having two layers made of polypropylene and pulp with conventional cone papers made of a single material such as aluminum (Al), wood, Medium-density fibreboard (MDF), pulp, polypropylene, and so on, in terms of the proportion relationship between their acoustic velocity and the internal loss. The more the cone paper is positioned to the upper-right portion of the graph, the high sound quality the cone paper has. As illustrated in FIG. 10, the cone paper 120 having two layers according to the exemplary embodiment of the present general inventive concept possesses superior sound quality than those of the other cone papers.

Figure 11:
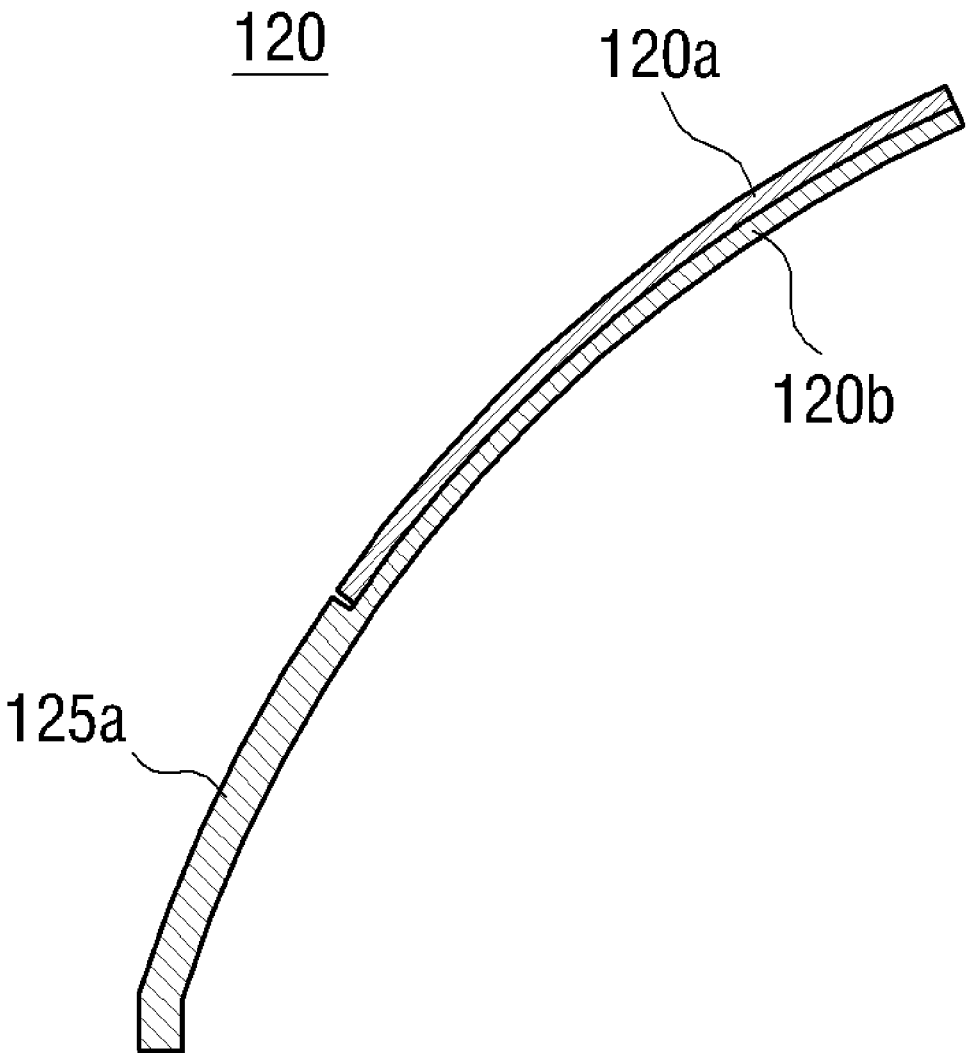
FIGS. 11 and 12 are cross-sectional views illustrating a cone paper according to an embodiment of the present general inventive concept.

As illustrated in FIG. 11, a first layer 120*a* of the cone paper 120 is disposed in an area other than the neck adhesive portion 125 to have a thickness. A second layer 120*b* may include a first portion 125*a* corresponding to the neck adhesive portion 125 and a second portion extended from the first portion 125*a* to form a recess area to receive the first layer 120*a* and having a thickness different from the thickness of the first portion 125*a*. A length of the first portion 125*a* of the second layer 120*b* may vary with respect to a surface direction of the cone paper 120 according to a design of the speaker 100. A thickness of the first portion 125*a* may be same as a sum of thicknesses of the first layer 120*a* and the second portion of the second layer 120*b*. The sum may include a thickness of the connecting unit, for example, glue B.

Figure 12:
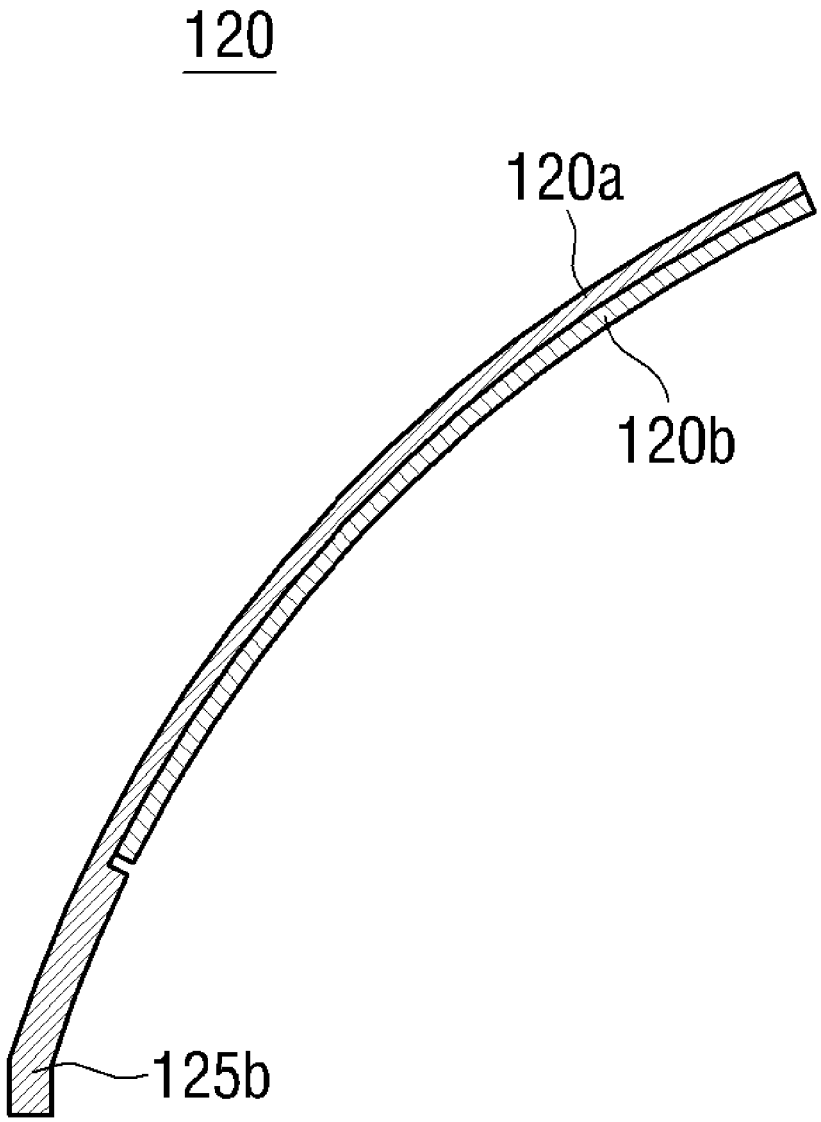

As illustrated in FIG. 12, a second layer 120*b* of the cone paper 120 is disposed in an area other than the neck adhesive portion 125 to have a thickness. A first layer 120*a* may include a first portion 125*b* corresponding to the neck adhesive portion 125 and a second portion extended from the first portion 125*a* to form a recess area to receive the second layer 120*b* and having a thickness different from the thickness of the first portion 125*b*. A length of the first portion 125*b* of the first layer 120*a* may vary with respect to a surface direction of the cone paper 120 according to a design of the speaker 100. A thickness of the first portion 125*b* may be same as a sum of thicknesses of the second layer 120*b* and the second portion of the first layer 120*b*. The sum may include a thickness of the connecting unit, for example, glue B.

Referring to FIGS. 13A through 13D, diaphragms 1300*a*, 1300*b*, 1300*c*, and 1300*d* may be formed as flat diaphragms or paper usable in a flat loudspeaker. Since the flat loudspeaker is well known in its structures and functions to generate sound according to an electrical signal in an electronic apparatus, detail descriptions thereof will be omitted.

Figure 13A:
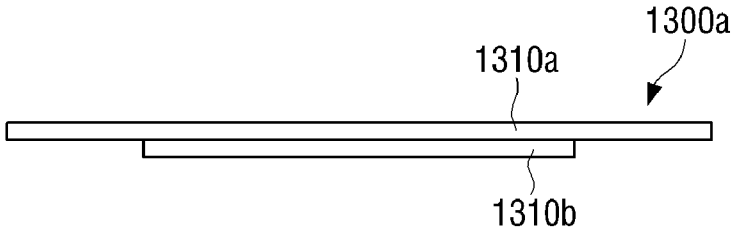
FIGS. 13A, 13B, 13C, and 13D are cross-sectional views illustrating a flat paper of a flat speaker according to an embodiment of the present general inventive concept.

As illustrated in FIG. 13A, the diaphragm 1300*a* includes a first layer 1310*a* disposed to face an outside of the speaker, and a second layer 1310*b* disposed to face an inside of the speaker, It is possible that a connecting unit, for example, glue, can be used and disposed between the first layer 1310*a* and the second layer 1310*b*. The first layer 1310*a* may have side portions to be connectable to a vibrating element of the flat speaker so that the diaphragm can be vibrated with respect to a speaker body of the speaker. The second layer 1310*a* may be disposed within the side portions of the first layer 1310*a* have a length shorter than a length of the first layer 1310*a* in a major plane of the speaker. Thicknesses of the first and second layers 1310*a* and 1310*b* may vary depending on a design of the speaker, for example, a frequency band of the sound, a characteristic of the speaker, etc.

Figure 13B:
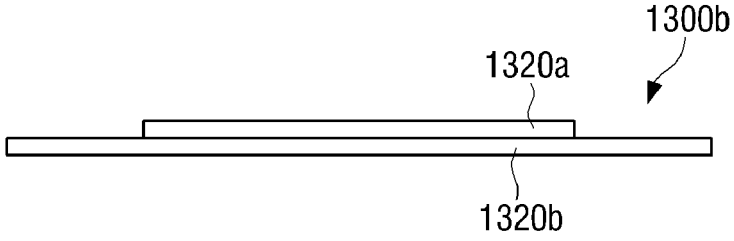

As illustrated in FIG. 13B, the diaphragm 1300*b* includes a first layer 1320*a* disposed to face an outside of the speaker, and a second layer 1320*b* disposed to face an inside of the speaker, It is possible that a connecting unit, for example, glue, can be used and disposed between the first layer 1320*a* and the second layer 1320*b*. The second layer 1320*b* may have side portions to be connectable to a vibrating element of the flat speaker so that the diaphragm can be vibrated with respect to a speaker body of the speaker. The second layer 1320*a* may have a length longer than a length of the first layer 1320*a* in a major plane of the speaker. Thicknesses of the first and second layers 1320*a* and 1320*b* may vary depending on a design of the speaker, for example, a frequency band of the sound, a characteristic of the speaker, etc.

Figure 13C:
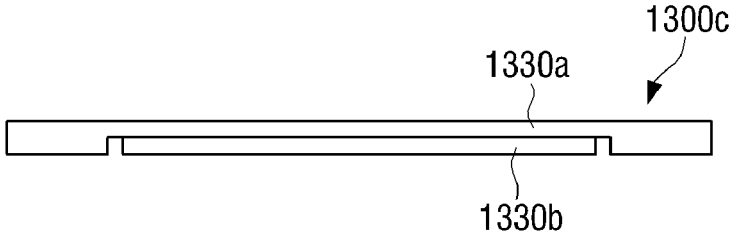

As illustrated in FIG. 13C, the diaphragm 1300*c* includes a first layer 1330*a* disposed to face an outside of the speaker, and a second layer 1330*b* disposed to face an inside of the speaker, It is possible that a connecting unit, for example, glue, can be used and disposed between the first layer 1330*a* and the second layer 1330*b*. The second layer 1330*b* may have a length shorter than a length of the first layer 1330*a* in a major plane of the speaker. Thicknesses of the first and second layers 1330*a* and 1330*b* may vary depending on a design of the speaker, for example, a frequency band of the sound, a characteristic of the speaker, etc. The second layer 1330*b* may have side portions disposed opposite to the first layer 1330*a* to form a recess to receive the first layer 1330*a* therein. The side portions may be connectable to a vibrating element of the speaker so that the diaphragm can be vibrated with respect to a speaker body of the speaker. The thickness of the side portions of the second layer 1330*b* may be a sum of a thickness of the first layer 1330*a* and a thickness of a center portion of the second layer 1330*a*, which is disposed between the side portions. It is possible that the sum includes a thickness of the connecting unit, for example, a thickness of the glue.

Figure 13D:
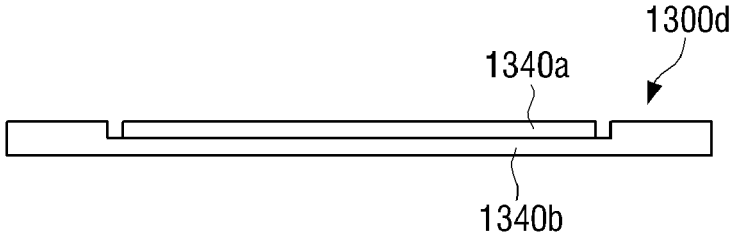

As illustrated in FIG. 13D, the diaphragm 1300*d* includes a first layer 1340*a* disposed to face an outside of the speaker, and a second layer 1340*b* disposed to face an inside of the speaker, It is possible that a connecting unit, for example, glue, can be used and disposed between the first layer 1340*a* and the second layer 1340*b*. The second layer 1340*b* may have a length longer than a length of the first layer 1340*a* in a major plane of the speaker. Thicknesses of the first and second layers 1340*a* and 1340*b* may vary depending on a design of the speaker, for example, a frequency band of the sound, a characteristic of the speaker, etc. The first layer 1340*a* may have side portions disposed opposite to the second layer 1340*b* to form a recess to receive the second layer 1340*b* therein. The side portions may be connectable to a vibrating element of the speaker so that the diaphragm can be vibrated with respect to a speaker body of the speaker. The thickness of the side portions of the first layer 1340*a* may be a sum of a thickness of the second layer 1340*b* and a thickness of a center portion of the first layer 1340*a*, which is disposed between the side portions. It is possible that the sum includes a thickness of the connecting unit, for example, a thickness of the glue.

As described above, an externally exposed layer, for example, the first layer, is made of polypropylene, an internal layer, for example, the second layer, is made of pulp, and the two layers are attached to each other to be in the thickness ratio of 1:1. The cone paper having two layers is formed. The cone paper according to the exemplary embodiment of the present invention may achieve both the advantages of polypropylene which forms various shapes and better appearance and is shockproof, and the advantages of pulp which produces various sounds.

According to the exemplary embodiment of the present general inventive concept, a speaker may be fabricated to have its own distinctive sound and design, and thus competitiveness of the speaker may be enhanced.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A speaker, comprising:

a speaker body;

a cone paper movably supported by the speaker body; and a magnetic driving unit disposed on the speaker body to vibrate the cone paper, wherein the cone paper includes at least two layers made of different materials, and wherein the at least two layers comprise a first layer and a second layer which have different lengths from each other in a surface direction.

2. The speaker of claim 1, wherein:

the first layer externally exposed, and made of polypropylene;

the second layer attached to a bottom surface of the first layer, and made of pulp; and the cone paper further comprises a connecting unit formed between the first layer and the second layer.

3. The speaker of claim 2, wherein a ratio of thicknesses of the first and second layers is 1:1.

4. The speaker of claim 3, wherein the cone paper comprises:

a neck adhesive portion spaced apart from a center of the cone paper at a predetermine distance, disposed in approximately 25% to 35% of an entire surface area of the cone paper, and coupled with a dust cap, wherein a portion of the second layer corresponding to the neck adhesive portion is removed.

5. The speaker of claim 4, wherein the thickness of the first layer of the neck adhesive portion is adjusted to be 101% to 200% of the first layer.

6. The speaker of claim 3, wherein the cone paper comprises a neck adhesive portion disposed apart from a center of the cone paper at a predetermine distance, disposed in approximately 25% to 35% of an entire surface area of the cone paper, and is coupled with a dust cap, wherein a portion of the first layer corresponding to the neck adhesive portion is removed.

7. The speaker of claim 6, wherein the thickness of the second layer of the neck adhesive portion is adjusted to be 101% to 200% of the second layer.

8. A speaker, comprising:

a speaker body; and a diaphragm movably disposed to vibrate with respect to the speaker body, wherein the diaphragm is made of at least two different materials, and comprises a first layer formed by the first material and a second layer made of the second material, and wherein the first layer and the second layer have different lengths in a surface direction.

9. The speaker of claim 8, wherein:

the first layer and the second layer are disposed on each other in a vibration direction of the diaphragm.

10. The speaker of claim 8, further comprising:

a driving unit having an element movably disposed on the speaker body to vibrate the diaphragm with respect to the speaker body, wherein the diaphragm comprises at least two layers formed of the corresponding at least two different materials, and one of the first layer and the second layer has opposite ends connected to the speaker body and the element of the driving units.

11. The speaker of claim 10, wherein the other one of the first layer and the second layer has one end connected to the speaker body.

12. The speaker of claim 8, further comprising:

a driving unit having an element movably disposed on the speaker body to vibrate the diaphragm with respect to the speaker body, wherein the first layer has one end coupled to the element of the driving unit, and the second layer has one end fixedly coupled to the speaker body.

13. The speaker of claim 12, wherein the element of the driving unit includes a bobbin and a coil, and the one end of the element is the bobbin.

14. The speaker of claim 8, wherein:

the first layer has a first thickness and the second layer has a second thickness.

15. The speaker of claim 14, wherein at least one of the first thickness and the second thickness is variable with respect to a surface direction of the diaphragm.

16. The speaker of claim 8, wherein the diaphragm has a thickness variable with respect to a surface direction of the diaphragm.

17. The speaker of claim 8, wherein:

the diaphragm has a ratio of the at least two different materials with respect to a surface direction of the diaphragm; and the ratio of the at least two different materials varies according to a distance from the speaker body.

18. The speaker of claim 8, wherein the at least two different materials of the diaphragm comprise polypropylene and pulp.

* * * * *